US008684457B2

(12) United States Patent
Kim et al.

(10) Patent No.: US 8,684,457 B2
(45) Date of Patent: Apr. 1, 2014

(54) CHAIR AND MULTIMEDIA PLAYER COMPRISING SOUND TRANSMISSION APPARATUS PERFORMING HUMAN BODY COMMUNICATIONS

(75) Inventors: Sung-Eun Kim, Seoul (KR); Sung-Weon Kang, Daejeon (KR); Tae-Wook Kang, Daejeon (KR); In-Gi Lim, Daejeon (KR); Hyung-Il Park, Daejeon (KR); Chang-Hee Hyoung, Daejeon (KR); Jung-Hwan Hwang, Daejeon (KR); Jin-Kyung Kim, Daejeon (KR); Jung-Bum Kim, Daejeon (KR); Kyung-Soo Kim, Daejeon (KR); Ki-Hyuk Park, Daejeon (KR); Jae-Hoon Shim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 683 days.

(21) Appl. No.: 12/918,573

(22) PCT Filed: Dec. 19, 2008

(86) PCT No.: PCT/KR2008/007537

§ 371 (c)(1), (2), (4) Date: Aug. 20, 2010

(87) PCT Pub. No.: WO2009/104862

PCT Pub. Date: Aug. 27, 2009

(65) Prior Publication Data

US 2010/0314921 A1 Dec. 16, 2010

(30) Foreign Application Priority Data

Feb. 20, 2008 (KR) ..... 10-2008-0015285
Jun. 9, 2008 (KR) ..... 10-2008-0053674

(51) Int. Cl.
*A47C 31/00* (2006.01)

(52) U.S. Cl.
USPC ..... 297/217.4; 297/217.1; 297/217.3; 381/151; 700/94

(58) Field of Classification Search
USPC ..... 297/217.4; 700/94; 381/151
See application file for complete search history.

(56) References Cited

U.S. PATENT DOCUMENTS 3,629,521 A * 12/1971 Puharich et al. ..... 607/56
6,587,729 B2 * 7/2003 O'Loughlin et al. ..... 607/55

(Continued)

FOREIGN PATENT DOCUMENTS

JP 2004-016522 A 1/2004
JP 2006-345477 A 12/2006

(Continued)

OTHER PUBLICATIONS

Jordi Agud Ruiz et al., "Experiment Evaluation of Body Channel Response and Digital Modulation Schemes for Intra-body Communications", IEEE ICC, 2006, pp. 349-354. IEEE.

(Continued)

*Primary Examiner* — Laurie Cranmer

(57) ABSTRACT

There is provided a chair and multimedia player comprising a sound transmission apparatus performing human-body communications. The chair and multimedia player comprise at least one sound transmission apparatus, wherein the sound transmission apparatus is disposed in a surface of the chair and multimedia player to allow a user to hear a sound signal when the user is in contact with or adjacent to the surface, and the sound transmission apparatus generates a composite signal including a sound signal and a demodulation signal restoring only the sound signal from the composite signal and outputs the generated composite signal and demodulation signal into a human body in order to restore the sound signal within the vicinity of the ears of the user.

12 Claims, 7 Drawing Sheets

(56) References Cited

U.S. PATENT DOCUMENTS

| | | | | |
|---|---|---|---|---|
| 7,171,177 | B2 * | 1/2007 | Park et al. | 455/188.1 |
| 7,553,288 | B2 * | 6/2009 | Cohen | 601/47 |
| 7,664,476 | B2 | 2/2010 | Yanagida | |
| 8,194,876 | B2 * | 6/2012 | Kim et al. | 381/77 |
| 2004/0202339 | A1 | 10/2004 | O'Brien, Jr. et al. | |
| 2006/0143004 | A1 | 6/2006 | Kim et al. | |
| 2006/0252371 | A1 * | 11/2006 | Yanagida | 455/41.1 |
| 2006/0269068 | A1 | 11/2006 | Yokota | |
| 2007/0086612 | A1 | 4/2007 | Nishibori et al. | |
| 2009/0103643 | A1 | 4/2009 | Hyoung et al. | |
| 2009/0250982 | A1 * | 10/2009 | Cohen | 297/217.4 |
| 2010/0205867 | A1 * | 8/2010 | Park | 52/8 |
| 2010/0320819 | A1 * | 12/2010 | Cohen et al. | 297/217.4 |

FOREIGN PATENT DOCUMENTS

| | | | |
|---|---|---|---|
| JP | 2007-036439 | A | 2/2007 |
| JP | 2007-184849 | A | 7/2007 |
| JP | 2007-221485 | A | 8/2007 |
| JP | 2008-027219 | A | 2/2008 |

OTHER PUBLICATIONS

International Search Report for PCT/KR2008/007537 filed Dec. 19, 2008.

Written Opinion of the International Searching Authority for PCT/KR2008/007537 filed Dec. 19, 2008.

* cited by examiner

CHAIR AND MULTIMEDIA PLAYER COMPRISING SOUND TRANSMISSION APPARATUS PERFORMING HUMAN BODY COMMUNICATIONS

TECHNICAL FIELD

The present invention relates to a sound transmission apparatus, and more particularly, to a chair and multimedia player comprising a sound transmission apparatus performing human-body communications in order for a user to hear a sound signal only by contact with a human body.

The work related to the present invention was partly supported by the IT R&D program of MIC/IITA [2006-S-072-02, Title: Human-body Communication Controller SoC].

BACKGROUND ART

Human body communication is a technology that removes an electric cable from electronic equipments and transfers a signal through the change in electric energy by using the human body instead of the electric cable, based on the principle that the electricity flows through the human body.

In the conventional sound transmission apparatus using the human body as the transfer medium, a sound transmission is achieved in a state where both a transmission apparatus and a reception apparatus are in direct contact with the human body. The transmission apparatus transmits a sound signal, and the reception apparatus receives the signal transmitted from the transmission apparatus and converts the received signal into a signal of a frequency band capable of being sensed by people.

That is, in a conventional sound transmission apparatus, when the transmission apparatus modulates a sound signal to be transferred into a signal which is able to be transmitted through the human body and thereafter transmits the modulated signal through the human body, the reception apparatus disposed to be in contact with the vicinity of the ear of a user receives the signal which is outputted from the transmission apparatus and transmitted through the human body, and converts the received signal into a sound signal of an audio frequency band by demodulating the received signal, thus to provide an audible signal.

However, such a conventional sound transmission apparatus is provided separately with the transmission apparatus and the reception apparatus, and enables users to hear sounds only when the reception apparatus is in contact with or adjacent to the human body.

Further, with a recent increase in demand for more diverse and complicated transmission apparatuses, users desire to hear a sound signal only by making contact with an object (i.e. a chair or a multimedia player) other than the sound transmission apparatus.

For example, there has been an increasing demand of users to hear a sound signal even when the users take a seat on the chair, or come in contact with a multimedia player.

Although products using the conventional sound transmission apparatus have developed to satisfy the above-mentioned requirements, but the conventional sound transmission apparatus have problems in that users are required to carry a receiving apparatus.

DISCLOSURE OF INVENTION

Technical Problem

An aspect of the present invention provides a chair and multimedia player developing a sound transmission apparatus and disposing the sound transmission apparatus on a surface of the chair and multimedia player to allow the user to hear a sound signal through a contact operation, so that the user can hear the sound signal only when user is contact with the surface.

Technical Solution

According to an aspect of the present invention, there is provided a chair comprising at least one sound transmission apparatus performing human-body communications, wherein the sound transmission apparatus is disposed in a surface of the chair to allow a chair user to hear a sound signal when the chair user is in contact with or adjacent to the surface of the chair, and the sound transmission apparatus generates a composite signal including a sound signal and a demodulation signal restoring only the sound signal from the composite signal and outputs the generated composite signal and demodulation signal into a human body in order to restore the sound signal within the vicinity of the ears of the chair user.

In this case, the sound transmission apparatus may be disposed in a surface of the back thereof that is contact with the back of the chair user, or disposed in a seat thereof that is in contact with the thigh of the chair user.

Also, the sound transmission apparatus may include a first sound transmitter combining a sound signal and a high frequency signal to generate a composite signal and outputting the generated composite signal into the human body; and a second sound transmitter generating a demodulation signal to offset the high frequency signal and outputting the generated demodulation signal into the human body.

In addition, the first sound transmitter and the second sound transmitter may be arranged on the surface thereof while being spaced apart from each other.

Additionally, the composite signal and the demodulation signal may have the same frequency but different phase. Here, the demodulation signal may be a high frequency demodulation signal having the same frequency as the high frequency signal but a different phase from the high frequency signal, or be generated by the combination of the high frequency demodulation signal and the sound signal.

According to another aspect of the present invention, there is provided a multimedia player comprising at least one sound transmission apparatus performing human-body communications, wherein the sound transmission apparatus is disposed in a surface of the multimedia player to allow a user to hear a sound signal when the user is in contact with or adjacent to the surface of the multimedia player, and the sound transmission apparatus generates a composite signal including a sound signal and a demodulation signal restoring only the sound signal from the composite signal and outputs the generated composite signal and demodulation signal into a human body in order to restore the sound signal within the vicinity of the ears of the user.

In this case, the multimedia player may be at least one selected from the group consisting of a portable multimedia player (PMP), personal digital assistants (PDAs), and an MPEG audio layer 3 (MP3).

Also, the sound transmission apparatus may include a first sound transmitter combining a sound signal and a high frequency signal to generate a composite signal and outputting the generated composite signal into the human body; and a second sound transmitter generating a demodulation signal to offset the high frequency signal and outputting the generated demodulation signal into the human body.

Additionally, the first sound transmitter and the second sound transmitter may be arranged on the surface thereof while being spaced apart from each other.

Furthermore, the composite signal and the demodulation signal may have the same frequency but different phase. Here, the demodulation signal may be a high frequency demodulation signal having the same frequency as the high frequency signal but a different phase from the high frequency signal, or be generated by the combination of the high frequency demodulation signal and the sound signal.

Advantageous Effects

As described above, the chair and multimedia player comprising a sound transmission apparatus performing human-body communications according to one exemplary embodiment of the present invention is configured to dispose the sound transmission apparatus on a surface of the chair and multimedia player to allow a user to hear a sound signal through a contact operation, so that a user can hear the sound signal generated and outputted from the sound transmission apparatus only when the user can hear the sound signal only when user is contact with the surface.

Therefore, the chair and multimedia player according to one exemplary embodiment of the present invention may be useful to provide a variety of services to the user, as well as to make it easier to use the corresponding services.

BEST MODE FOR CARRYING OUT THE INVENTION

Figure 1:
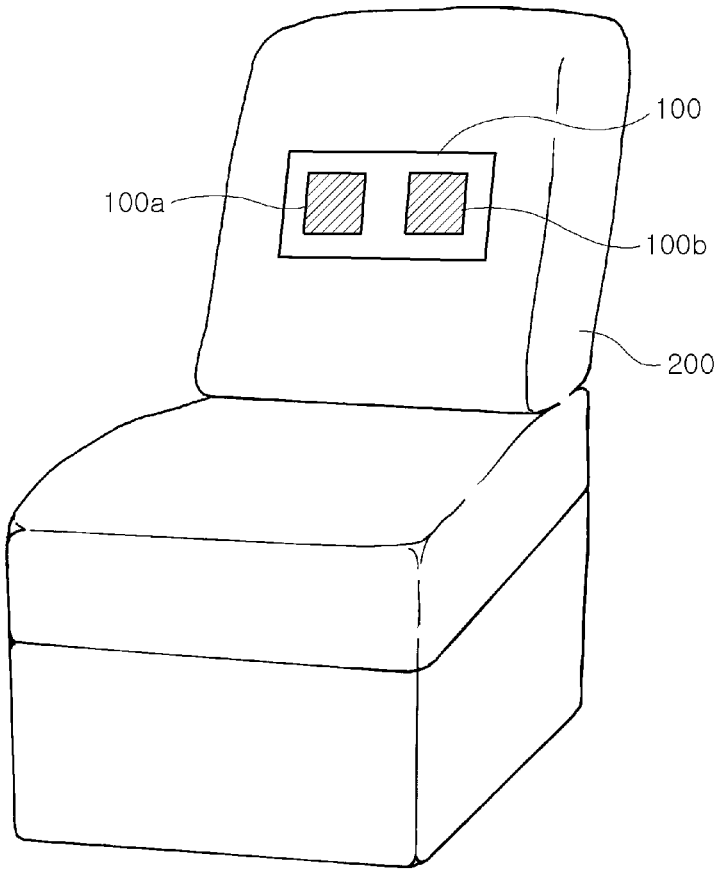
FIG. 1 is a diagram illustrating a chair having a sound transmission apparatus according to one exemplary embodiment of the present invention installed therein.

Hereinafter, exemplary embodiment of the present invention will be described in detail with reference to the accompanying drawings, as apparent to those skilled in the art to which the present invention belongs.

In order to describe an operation principle of a chair and multimedia player according to exemplary embodiment of the present invention, however, detailed descriptions of known functions and constructions that are related to the present invention are omitted for clarity when they are unnecessarily proven to make the gist of the present invention unnecessarily confusing.

Furthermore, for reference numerals that are marked hereinafter in the accompanying drawings, parts and their related counterparts that have the same functions in these exemplary embodiments of the present invention are represented by the same numbers or their serial numbers.

FIG. 1 is a diagram illustrating a chair having a sound transmission apparatus according to one exemplary embodiment of the present invention installed therein.

Referring to FIG. 1, the chair according to one exemplary embodiment of the present invention has at least one sound transmission apparatus 100 installed therein, where the sound transmission apparatus 100 generates a composite signal including a sound signal and a demodulation signal restoring only the sound signal from the composite signal, outputs the generated composite signal and demodulation signal into a human body and restores the sound signal within the vicinity of the ears of a user. In this case, the sound transmission apparatus 100 is disposed in a surface of the chair.

The sound transmission apparatus 100 includes a first sound transmitter 100*a* combining a sound signal and a high frequency signal to generate a composite signal and outputting the generated composite signal into a human body of a chair user; and a second sound transmitter 100*b* destructively interferes with the high-frequency signal within the vicinity of the ears of the user to generate a demodulation signal in order to restore the sound signal and outputting the generated demodulation signal into the human body of the chair user.

When the chair user takes a seat on the chair 200, the first sound transmitter 100*a* and the second sound transmitter 100*b* output a composite signal and a demodulation signal into a human body of the chair user. When the composite signal and the demodulation signal are transmitted through the human body and met with each other within the vicinity of the ears of the chair user, the composite signal and the demodulation signal are restored into a sound signal through the destructive interference. Then the chair user senses and hears the sound signal restored in the vicinity of his own ears without carrying an additional receiving apparatus.

Preferably, the chair user may be in easier contact with or be adjacent to the sound transmission apparatus 100 by disposing the sound transmission apparatus 100 in the back of the chair that is in contact with a chair user or in a seat of the chair that is in contact with the thigh of the chair user.

Figure 2:
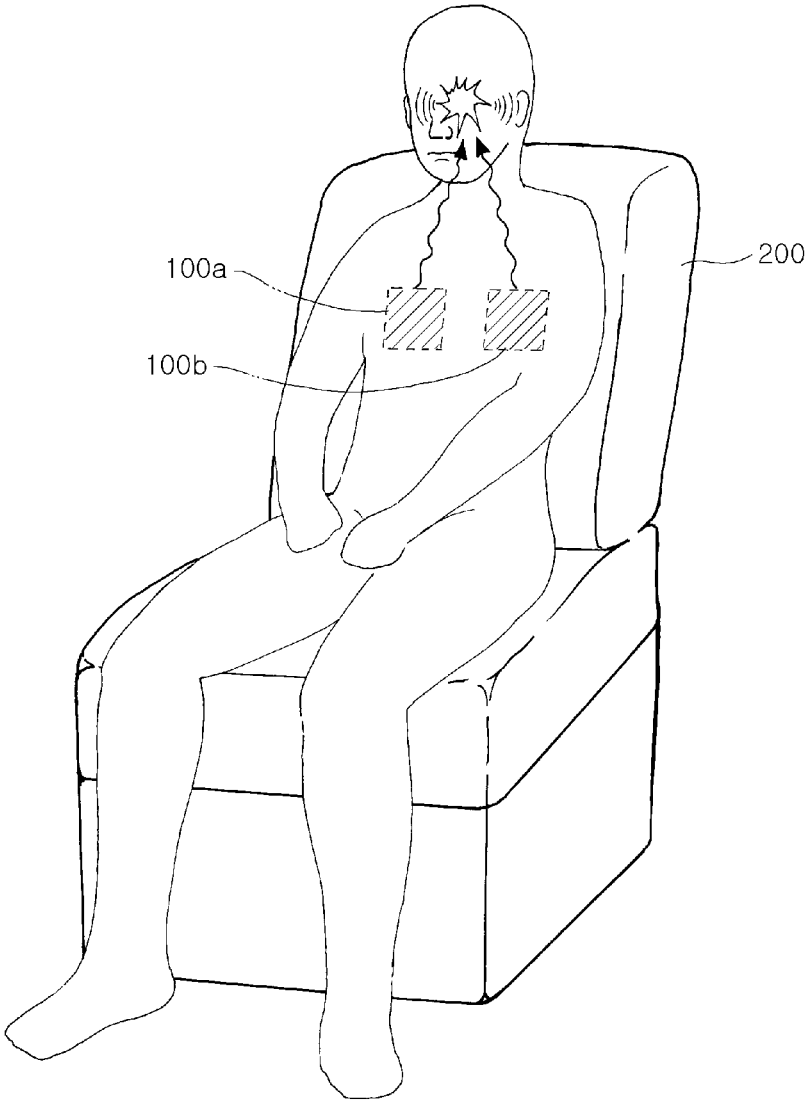
FIG. 2 is a diagram illustrating transmission paths of a composite signal and a demodulation signal that are outputted from the sound transmission apparatus when a user takes a seat on the chair as shown in FIG. 1.

FIG. 2 is a diagram illustrating transmission paths of a composite signal and a demodulation signal that are outputted from the sound transmission apparatus 100 when a user takes a seat on the chair as shown in FIG. 1.

As shown in FIG. 2, the composite signal and the demodulation signal outputted from the first and second sound transmitters 100*a* and 100*b* are transmitted through a human body of a chair user that is in contact with or is adjacent to the first and second sound transmitters 100*a* and 100*b*, and then destructively interfere with each other within the vicinity of the ears of the chair user.

As a result, the chair user may sense and hear the sound signal restored in the vicinity of the ears.

As described above, only the chair has been in fact described as one example of furniture comprising the sound transmission apparatus 100, but the sound transmission apparatus 100 of the present invention may apply to the field of applications such as various pieces of furniture (i.e. sofas, beds, and desks) like the chair that a user is in contact with or adjacent to.

Figure 3:
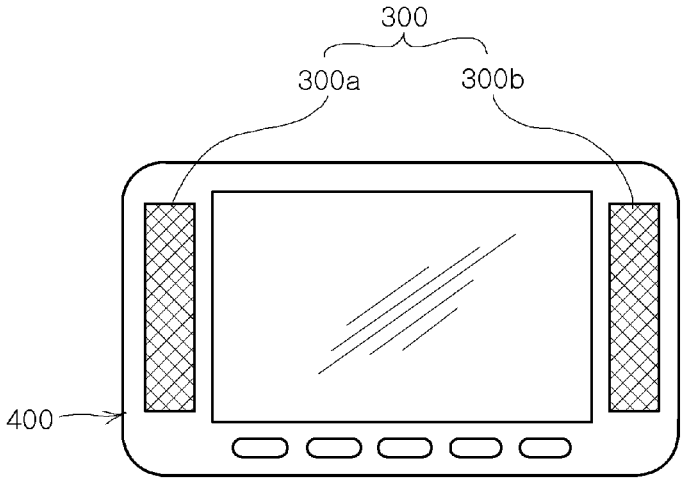
FIG. 3 is a diagram illustrating electronic equipment having a sound transmission apparatus according to another exemplary embodiment of the present invention installed therein.

FIG. 3 is a diagram illustrating a multimedia player comprising a sound transmission apparatus performing human-body communications according to another exemplary embodiment of the present invention. Here, examples of the multimedia player include a portable multimedia player (PMP), personal digital assistants (PDAs), an MPEG Audio Layer-3 (MP3) and a navigation system.

Referring to FIG. 3, the multimedia player 400 according to another exemplary embodiment of the present invention has at least one sound transmission apparatus 300 installed therein, where the sound transmission apparatus 300 generates a composite signal including a sound signal and a demodulation signal restoring only the sound signal from the composite signal, outputs the generated composite signal and demodulation signal into a human body and restores the sound signal within the vicinity of the ears of a user. In this case, the sound transmission apparatus 300 is disposed in a surface of the multimedia player 400.

In this case, the sound transmission apparatus 300 includes first and second sound transmitters 300*a* and 300*b* like the sound transmission apparatus 100 of FIG. 1. Here, the first and second sound transmitter 300*a* and 300*b* generate a composite signal and a demodulation signal, respectively, which destructively interfere with each other within the vicinity of the ears of a multimedia player user in order to restore a sound signal, and output the generated composite signal and demodulation signal into a human body.

As a result, the multimedia player user may hear the sound signal restored in the vicinity of his own ears without using an additional receiving apparatus.

As described above, only the multimedia player has been in fact described as one example of electronic equipment comprising the sound transmission apparatus 300, but the sound transmission apparatus 300 of the present invention may apply to the field of applications such as human interface devices including a mouse, a keyboard, a game pad, a joystick, etc.

Also, the composite signal and the demodulation signal may not only destructively but also constructively interfere with each other by the overlapping of signals. However, humans do not sense a signal generated by the constructive interference since the generated signal is a signal having an audio frequency band exceeding that of a sound signal that humans cannot hear.

Hereinafter, a configuration of the sound transmission apparatus according to one exemplary embodiment of the present invention will be described in more detail with reference to FIG. 4.

Figure 4:
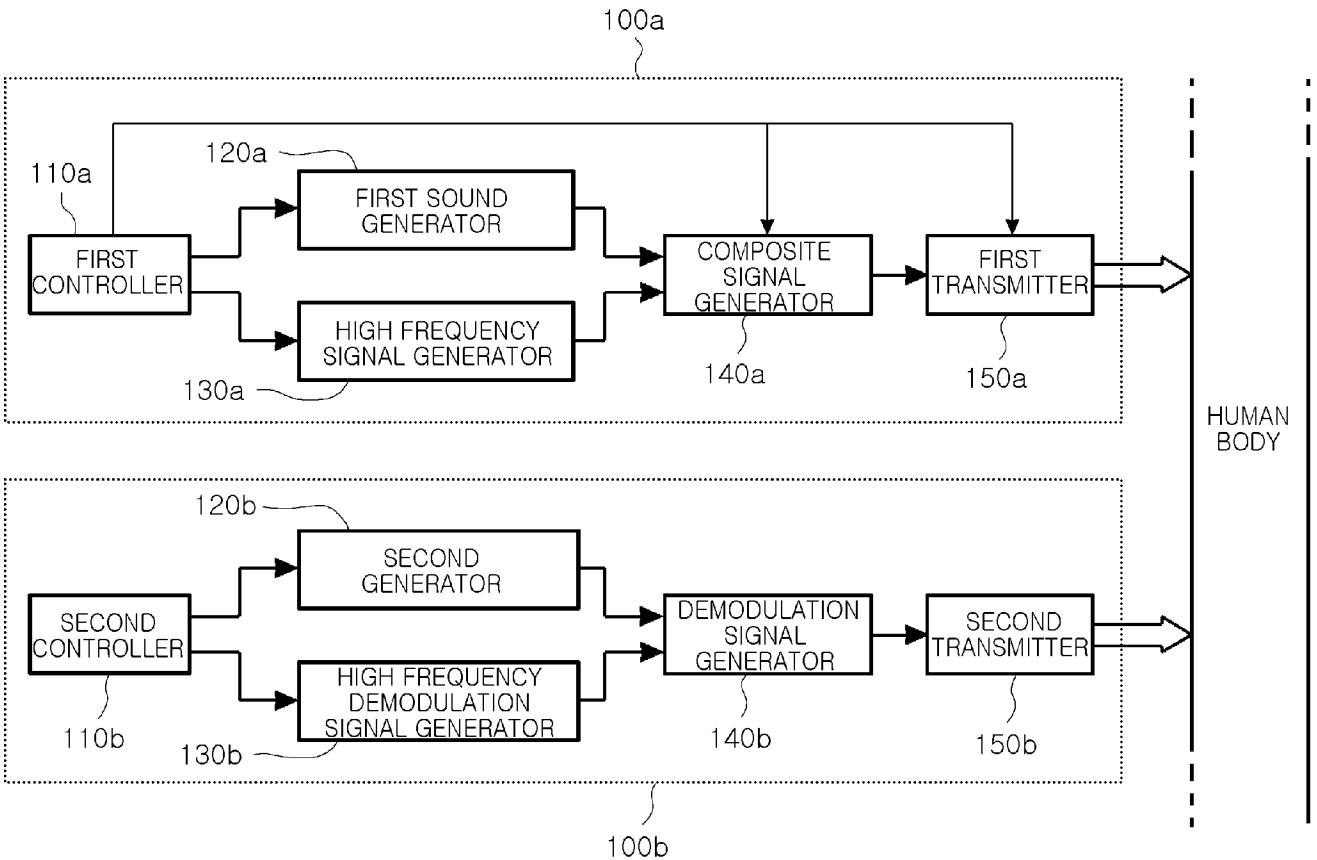
FIG. 4 is a diagram illustrating a configuration of the sound transmission apparatus according to one exemplary embodiment of the present invention.

FIG. 4 is a diagram illustrating a configuration of the sound transmission apparatus according to one exemplary embodiment of the present invention.

Referring to FIG. 4, the first sound transmitter (for example, 100*a*) includes a first controller 110*a* determining a frequency and a phase of a composite signal interfering with a demodulation signal within the vicinity of the ears of a user so as to restore a sound signal; a first sound generator 120*a* generating a sound signal having an audio frequency band; a high frequency signal generator 130*a* generating a high frequency signal having a higher frequency than the audio frequency band under the control of the first controller 110*a*; a composite signal generator 140*a* combining a sound signal and a high frequency signal; and a transmitter 150*a* shifting a phase of the composite signal under the control of the first controller 110*a* and outputting the composite signal into a human body.

The second sound transmitter (for example, 100*b*) includes a second controller 110*b* determining a frequency and a phase of a demodulation signal destructively interfering with the composite signal within the vicinity of the ears of a user in order to restore a sound signal; a second sound generator 120*b* generating a sound signal having an audio frequency band; a high frequency demodulation signal generator 130*b* generating a high frequency demodulation signal under the control of the second controller 110*b*, wherein the high frequency demodulation signal has a higher frequency than the audio frequency band in order to destructively interfere with the high frequency signal of the composite signal; a demodulation signal generator 140*b* combining the sound signal and the high frequency demodulation signal to generate a demodulation signal; and a transmitter 150*b* shifting a phase of the demodulation signal under the control of the second controller 110*b* and outputting the demodulation signal into a human body.

The two first and second controllers 110*a* and 110*b* set frequencies and phases of signals (i.e. the composite signal and the demodulation signal) that they will output, depending on the distance from the ears of a user that is in contact with the first and second controllers 110*a* and 110*b* themselves, and the impedance of the corresponding human body of the user.

In particular, the first and second controllers 110*a* and 110*b* may set frequencies and phases of the composite signal and the demodulation signal so that the composite signal and the demodulation signal can have the same frequency but different phase (for example, complementary phase) when they meets each other within the vicinity of the ears of the user, and restore a sound signal by allowing the composite signal and the demodulation signal to destructively interfere with each other in the vicinity of the ears of the user.

Also, the two first and second controllers 110*a* and 110*b* may control output rates of the composite signal and the demodulation signal under the control of the high frequency signal generators 130*a* and 130*b* and the transmitters 150*a* and 150*b*, when necessary. This is to provide a stereophonic sound effect by adjusting a human body region in which the destructive interference occurs, and the time at which the destructive interference occurs.

On the contrary, the sound signals generated in the two first and second sound generators 120*a* and 120*b* have the same information, as well as the same frequency and phase. And the high frequency signals generated in the two high frequency signal generators 130*a* and 130*b* may be ultrasonic signals that are sound waves having a higher frequency spectrum than the audio frequency band (~20 KHz) at which a human could hear a sound signal.

Hereinafter, an operation of the sound transmission apparatus as shown in FIG. 4 will be described in more detail with reference to FIG. 5.

Figure 5:
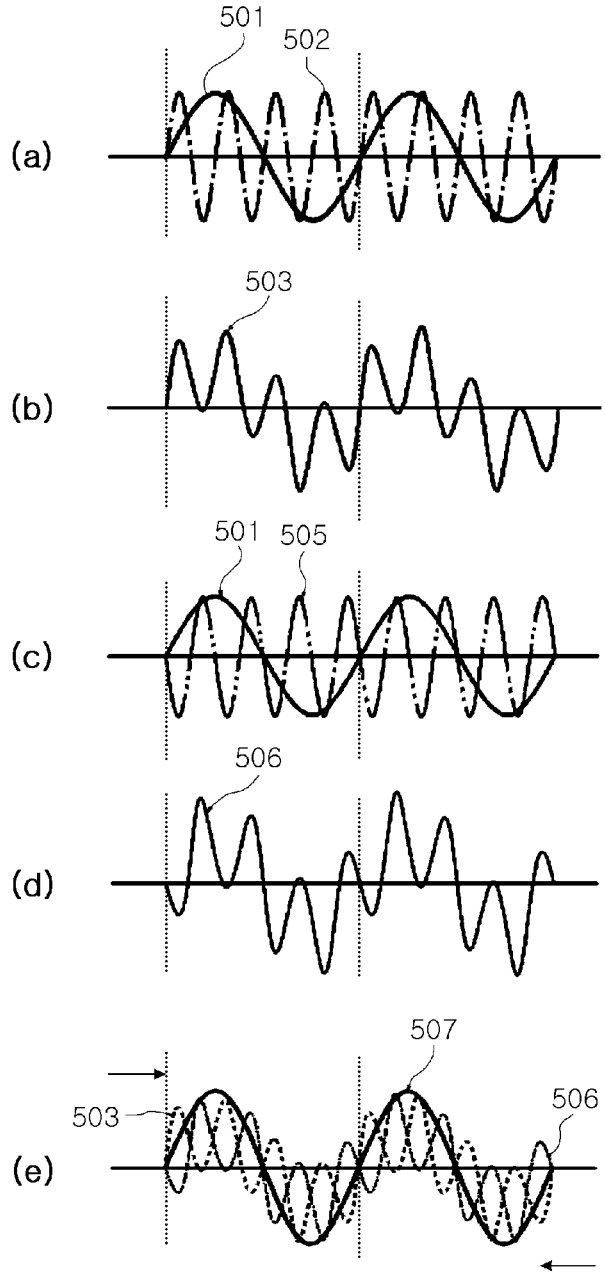
FIG. 5 is a diagram illustrating an operation of the sound transmission apparatus as shown in FIG. 4.

As shown in FIG. 5 (A), the first sound transmitter (for example, 100*a*) generates a sound signal 501 having an audio frequency band and a high frequency signal 502 having a higher frequency than those of the sound signal 501, combines the sound signal 501 and the high frequency signal 502 to generate a composite signal 503 as shown in FIG. 5 (B), and outputs the generated composite signal 503 into a human body.

At the same time, the second sound transmitter (for example, 100*b*) generates a sound signal 501 having an audio frequency band and a high frequency demodulation signal 505 having the same frequency as the high frequency signal of the first sound transmitter 100*a* and a different phase from the high frequency signal of the first sound transmitter 100*a*, as shown in FIG. 5 (C). And, the sound signal 501 and the high frequency demodulation signal 505 are combined to generate a demodulation signal 506 as shown in FIG. 5 (D), and the generated demodulation signal 506 is outputted into a human body.

The composite signal 503 and the demodulation signal 506 outputted respectively from the first sound transmitter 100*a* and the second sound transmitter 100*b* are transmitted through the human body, and destructively interfere with each other within the vicinity of the ears of a user, as shown in FIG. 5 (E). Then the high frequency signal 502 and the high frequency demodulation signal 505 having the same frequency but different phase disappear by destructively interfering with each other, and only a sound signal 507 remains.

As a result, a user of the sound transmission apparatus senses and hears the sound signal 507 restored within the vicinity of the ears of the user without carrying an additional receiving apparatus.

Figure 6:
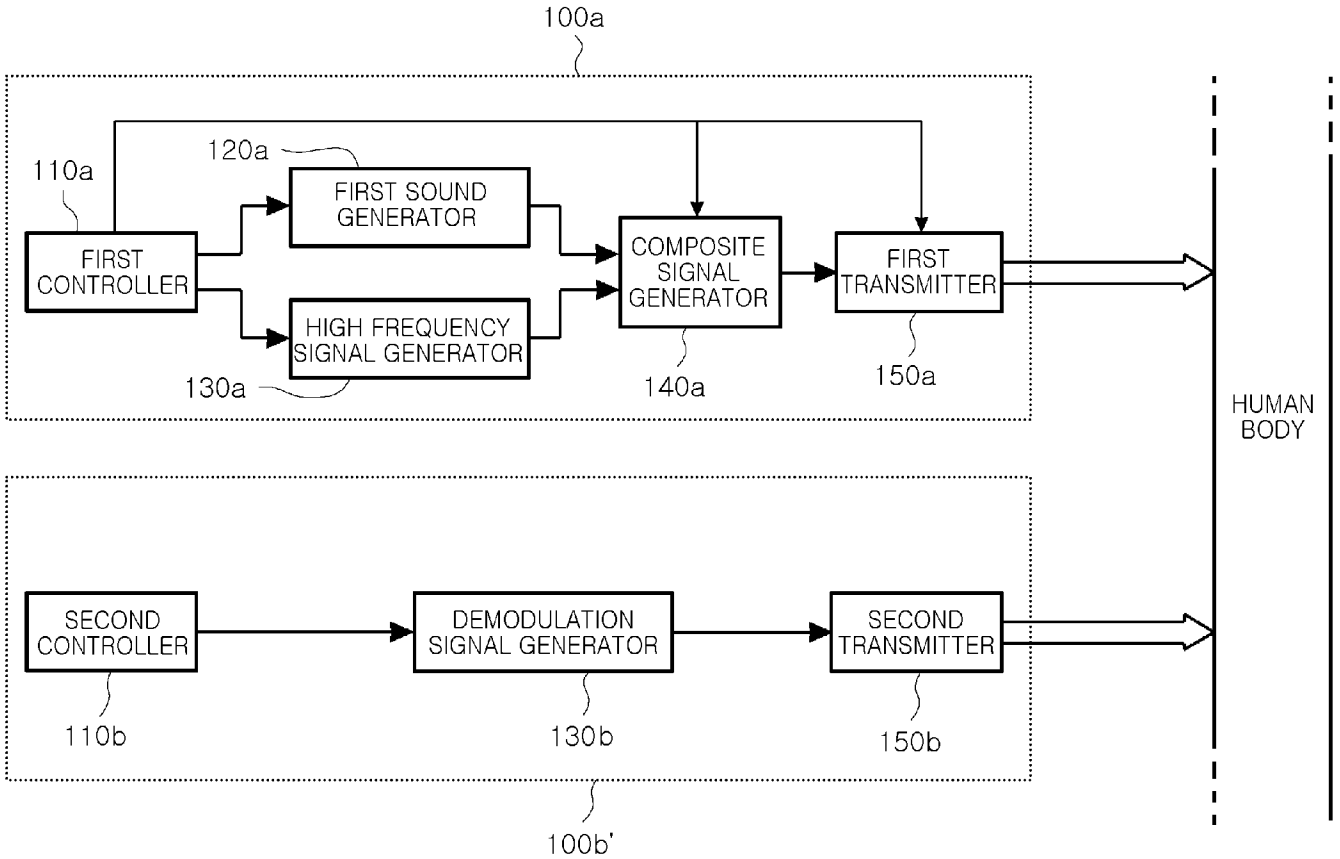
FIG. 6 is a diagram illustrating a configuration of the sound transmission apparatus according to another exemplary embodiment of the present invention.

FIG. 6 is a diagram illustrating a configuration of the sound transmission apparatus according to another exemplary embodiment of the present invention. Here, a first sound transmitter 100*a* has the same configuration as shown in FIG. 4, but a second sound transmitter 100*b*' has a different configuration from that as shown in FIG. 4.

Referring to FIG. 6, the second sound transmitter 100*b*' includes a second controller 110*b*, a high frequency demodulation signal generator 130*b* and a transmitter 150*b*, except for a second sound generator 120*b* and a demodulation signal generator 140*b*.

That is, the second sound transmitter 100*b*' of FIG. 6 generates only a high frequency demodulation signal without generation of a sound signal, the high frequency demodulation signal functioning to destructively interfere with the high frequency signal of the first sound transmitter 100*a*, and outputs the generated high frequency demodulation signal.

Hereinafter, an operation of the sound transmission apparatus as show in FIG. 6 will be described in more detail with reference to FIG. 7.

Figure 7:
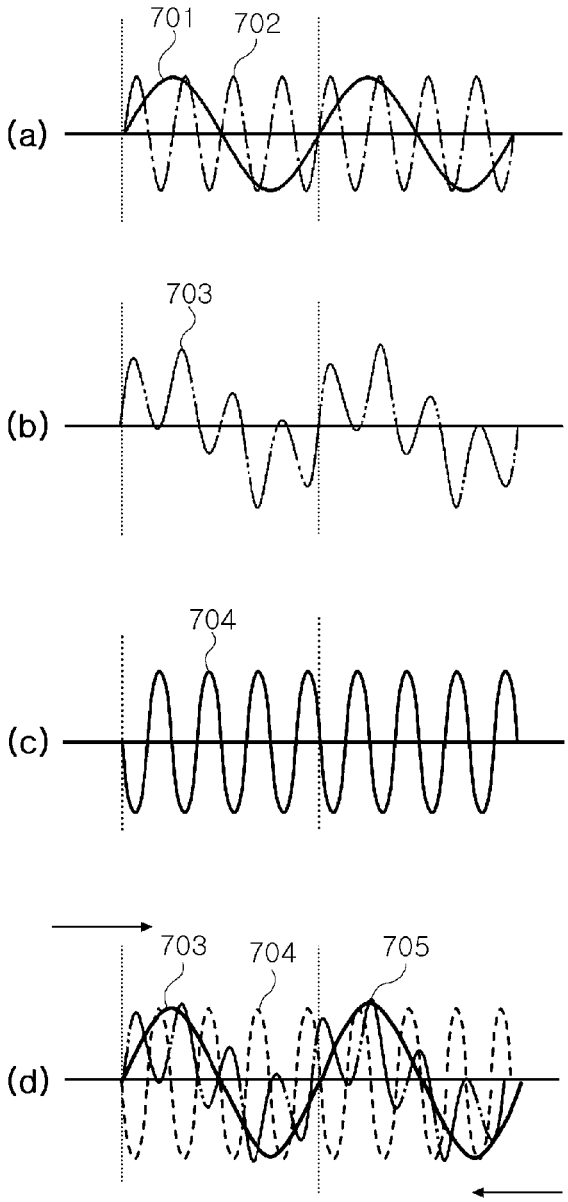
FIG. 7 is a diagram illustrating an operation of the sound transmission apparatus as shown in FIG. 6.

The first sound transmitter 100*a* generates a sound signal 601 having an audio frequency band and a high frequency signal 602 having a higher frequency than the audio frequency band of the sound signal 601, as shown in FIG. 7 (A). Then the generated sound signal 601 and high frequency signal 602 are combined to generate a composite signal 603 as shown in FIG. 7 (B), and the generated composite signal 603 is outputted into a human body.

On the contrary, the second sound transmitter 100*b* generates a high frequency demodulation signal 604 including only a high frequency signal having the same frequency as the high frequency signal of the first sound transmitter 100*a* but a different phase from the high frequency signal of the first sound transmitter 100*a*, and outputs the generated high frequency demodulation signal 604 into a human body, as shown in FIG. 7 (C).

The composite signal 603 and the high frequency demodulation signal 604 outputted respectively from the first sound transmitter 100*a* and the second sound transmitter 100*b* are transmitted through the human body, and destructively interfere with each other within the vicinity of the ears of a user to restore a sound signal 605, as shown in FIG. 7 (D)

Also, the above-mentioned exemplary embodiments of the present invention disclose that the destructive interference has occurred within the vicinity of the ears of a user by adjusting a phase of the high frequency signal, but the destructive interference may also occur under the control of frequencies of signals outputted from the first and second sound generators 120*a* and 120*b* and the high frequency signal generators 130*a* and 130*b*, when necessary.

Where a sound signal to be transmitted has a frequency of f0, for example, the sound transmission apparatus may be controlled by outputting a sound signal having a frequency of from each of the first and second sound generators 120*a* and 120*b* of the sound transmitter s 100*a* and 100*b*, outputting a high frequency signal having a frequency of f1 from each of the high frequency signal generators 130*a* and 130*b* of the sound transmitter s 100*a* and 100*b*, and outputting signals having frequencies of and, respectively, from the composite signal generators 140*a* and 140*b*.

Such outputted signals are combined into a signal having a frequency of f0 within the vicinity of the ears of a user, and the composite signal is transmitted to a human body.

As described above, any combination of signals may be used if a sound signal having a desired frequency may be generated through the combination of signals outputted from the sound transmitters 100*a* and 100*b* that is in contact with a human body.

The exemplary embodiments of the present invention have been described in detail. However, it should be understood that the detailed description and specific examples, while indicating preferred embodiments of the invention, are given by way of illustration only, since various changes and modifications within the scope of the invention will become apparent to those skilled in the art from this detailed description.

The invention claimed is:

1. A chair comprising at least one sound transmission apparatus performing human-body communications, wherein the sound transmission apparatus is disposed in a surface of the chair to allow a chair user to hear a sound signal when the chair user is in contact with the surface of the chair;

wherein the sound transmission apparatus generates a composite signal and a demodulation signal, the composite signal including a sound signal and a high frequency signal, the demodulation signal restoring only the sound signal from the composite signal by removing the high frequency signal; and wherein the sound transmission apparatus outputs the generated composite signal and the demodulation signal into a body of the chair user in order to restore the sound signal in the body within the vicinity of the ears of the chair user.

2. The chair of claim 1, wherein the sound transmission apparatus is disposed in a surface of the back thereof that is in contact with the back of the chair user, or disposed in a seat thereof that is in contact with the thigh of the chair user.

3. The chair of claim 1, wherein the sound transmission apparatus comprises:

a first sound transmitter combining the sound signal and the high frequency signal to generate the composite signal and outputting the generated composite signal into the human body; and a second sound transmitter generating the demodulation signal to offset the high frequency signal and outputting the generated demodulation signal into the human body.

4. The chair of claim 3, wherein the first sound transmitter and the second sound transmitter are arranged on the surface thereof while being spaced apart from each other.

5. The chair of claim 3, wherein the composite signal and the demodulation signal have the same frequency but different phases.

6. The chair of claim 3, wherein the demodulation signal is a high frequency demodulation signal having the same frequency as the high frequency signal but a different phase from the high frequency signal, or generated by the combination of the high frequency demodulation signal and the sound signal.

7. A multimedia player comprising at least one sound transmission apparatus performing human-body communications, wherein the sound transmission apparatus is disposed in a surface of the multimedia player to allow a user to hear a sound signal when the user is in contact with the surface of the multimedia player;

wherein the sound transmission apparatus generates a composite signal and a demodulation signal, the composite signal including a sound signal and a high frequency signal, the demodulation signal restoring the sound signal from the composite signal by removing the high frequency signal; and wherein the sound transmission apparatus outputs the generated composite signal and demodulation signal into a body of a user in order to restore the sound signal in the body within the vicinity of the ears of the user.

8. The multimedia player of claim 7, wherein the multimedia player is at least one selected from the group consisting of a portable multimedia player (PMP), personal digital assistants (PDAs), and an MPEG audio layer 3 (MP3).

9. The multimedia player of claim 7, wherein the sound transmission apparatus comprises:

a first sound transmitter combining the sound signal and the high frequency signal to generate the composite signal and outputting the generated composite signal into the human body; and a second sound transmitter generating the demodulation signal to offset the high frequency signal and outputting the generated demodulation signal into the human body.

10. The multimedia player of claim 9, wherein the first sound transmitter and the second sound transmitter are arranged on the surface thereof while being spaced apart from each other.

11. The multimedia player of claim 9, wherein the composite signal and the demodulation signal have the same frequency but different phases.

12. The multimedia player of claim 9, wherein the demodulation signal is a high frequency demodulation signal having the same frequency as the high frequency signal but a different phase from the high frequency signal, or generated by the combination of the high frequency demodulation signal and the sound signal.

* * * * *